US008398905B2

(12) United States Patent
Nilsson

(10) Patent No.: US 8,398,905 B2
(45) Date of Patent: Mar. 19, 2013

(54) PARTICLE BOARD

(75) Inventor: Bo Nilsson, Morlunda (SE)

(73) Assignee: Swedwood International AB, Angelholm (SE)

( * ) Notice: Subject to any disclaimer, the term of this patent is extended or adjusted under 35 U.S.C. 154(b) by 0 days.

(21) Appl. No.: 13/468,713

(22) Filed: May 10, 2012

(65) Prior Publication Data

US 2012/0217671 A1 Aug. 30, 2012

Related U.S. Application Data

(62) Division of application No. 10/595,743, filed as application No. PCT/SE2004/001647 on Nov. 12, 2004.

(30) Foreign Application Priority Data

Nov. 13, 2003 (SE) ..... 0302991

(51) Int. Cl.
*B27N 3/00* (2006.01)

(52) U.S. Cl. ..... 264/113; 264/109

(58) Field of Classification Search ..... None
See application file for complete search history.

(56) References Cited

U.S. PATENT DOCUMENTS

| | | | | |
|---|---|---|---|---|
| 3,171,872 | A | 3/1965 | Jarrett et al. | |
| 4,148,857 | A | 4/1979 | Wheeler | |
| 4,213,928 | A * | 7/1980 | Casselbrant | 264/113 |
| 4,236,365 | A | 12/1980 | Wheeler | |
| 4,636,159 | A * | 1/1987 | Heller et al. | 425/148 |
| 6,197,142 | B1 * | 3/2001 | Wolff | 156/177 |
| 6,409,856 | B1 | 6/2002 | Wiemann | |
| 6,986,939 | B2 * | 1/2006 | Herlyn | 428/212 |
| 7,658,873 | B2 * | 2/2010 | Chen et al. | 264/109 |

FOREIGN PATENT DOCUMENTS

| | | | |
|---|---|---|---|
| AU | 199877427 | B2 | 1/1999 |
| EP | 0065941 | A2 | 12/1982 |
| EP | 0162118 | A1 | 11/1986 |
| EP | 1184525 | | 3/2002 |

OTHER PUBLICATIONS

EPODOC/EPO: Daiken Trade & Industry, "Wooden Fiber Composite Material" JP 7227814 A, Aug. 29, 1995, Figure 1.

* cited by examiner

*Primary Examiner* — Mary F Theisen
(74) *Attorney, Agent, or Firm* — Alston & Bird, LLP

(57) ABSTRACT

The present invention relates to a particle board comprising a lower and an upper surface layer (9, 11) having a finer fraction of particles (4), and between these surface layers (9, 11) an intermediate layer (13) having a coarser fraction of particles (5). The intermediate layer (13) has a varying density.

8 Claims, 3 Drawing Sheets

Fig. 5a
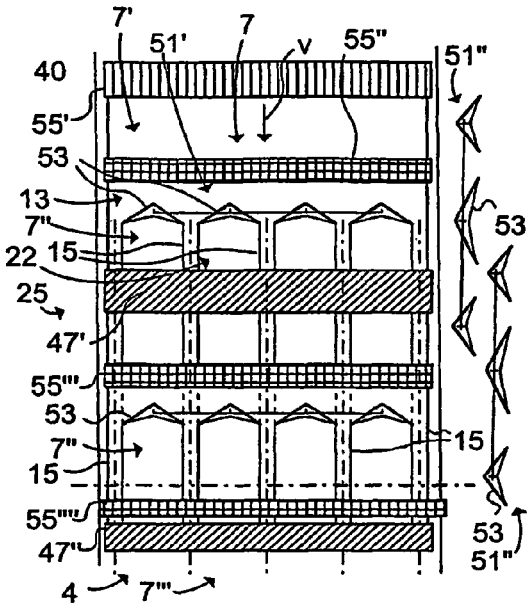
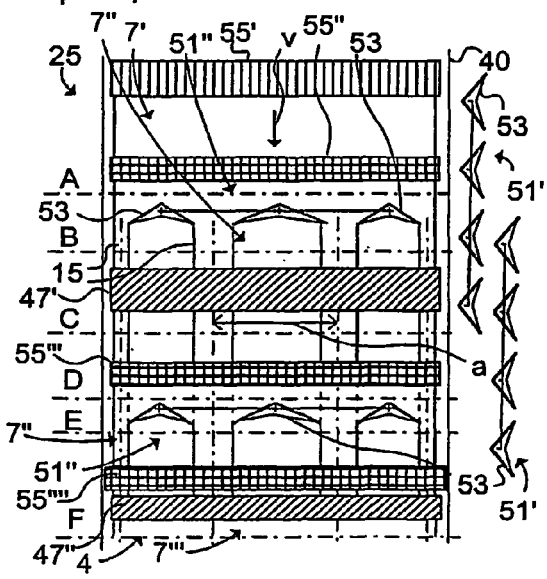
Fig. 5b
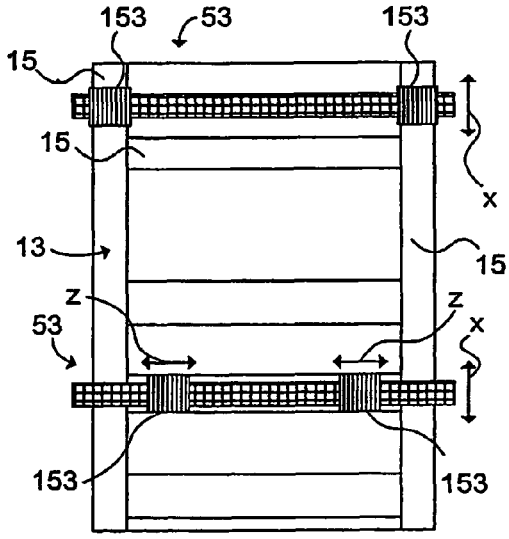
Fig. 5d

PARTICLE BOARD

CROSS REFERENCE TO RELATED APPLICATIONS

This application is a divisional of U.S. application Ser. No. 10/595,743 filed Oct. 10, 2008, which is a national phase entry of PCT/SE2004/001647 filed Nov. 12, 2004, which claims priority to Swedish Patent Application No. 0302991-5, filed Nov. 13, 2003.

BACKGROUND

The present invention relates to a particle board and also relates to a method of manufacture of a particle board.

The present invention has applications in the particle board manufacturing industry, but is not limited thereto, the invention also possibly relating to other types of wood-based boards, such as MDF and OSB (oriented strand board). Wood-based boards are in turn used, for example, for the manufacture of furniture and in the building industry.

Known particle boards currently available on the market comprise an upper and a lower layer of finer wood particles and an intermediate layer of coarser wood particles. The particle board is manufactured under pressure and heat using adhesive as binder. The wood particles may be of wood and/or other lignocellulose material and may consist, for example of blade-cut particles from round timber, sawdust or chip particles. Examples of particle material other than wood are flax straw, hemp and bagasse.

Nowadays the intermediate layer is manufactured with an even particle density in order that the particle board will have as uniform a quality as possible over its entire surface. The density of the intermediate layer may be in the order of 660-700 kilograms per cubic meter.

In order produce a known particle board, the finer particle fraction, which has previously been mixed with binder, is first spread out on a belt and is distributed with an even thickness over the belt, the so-called surface particles. The coarse particle fraction, also called the core particles, which have likewise been mixed with binder, is then spread out evenly distributed in a thicker layer over the finer particles. The upper surface layer of a finer particle fraction is spread out over the evenly distributed coarse particle fraction forming a particle mat. The particle mat is then compressed so that most of the air present between the particles is expelled.

The spread particle mat, or the particle mass, is then pressed under pressure and heat. After pressing the board takes on a solid structure and is cooled. Finally, surface planes of the board are sanded in order to eliminate any discolouration and irregularities. The board is delivered and the recipient can apply a suitable surface layer for further processing.

The known method suffers from the disadvantage, however, that the cost of the middle layer of materials, such as particles and binder, is high. Known particle boards are also heavy, which means heavy haulage and unnecessary impact on the external environment.

It is desirable that the particle board should have sound and heat-insulating properties, since it may also be used in the building industry.

BRIEF SUMMARY

The object is achieved by the particle board described above comprising the features specified further herein. In this way a particle board of largely even thickness has been produced, which in certain parts has a smaller quantity of material, which contributes to a lower material cost and lower weight.

The intermediate layer suitably has a higher density in areas where the particle board is intended for fastening to another object.

The particle board can thereby be used, for example, for a cupboard door, on which objects such as hinges and handles are arranged in the higher density area of the intermediate layer. Other parts of the intermediate part are more porous and hence lighter, which makes for cost-effective transport of processed particle boards.

Alternatively the intermediate layer has at least one stranded part formed from particles, having a higher density than at least one other surrounding part of said intermediate layer.

Alternatively at least one edge of the particle board coincides with a part of said intermediate layer having a higher density than the other part of said intermediate layer.

In this way the edge area of the particle board can be used for fastening various types of objects and the edges can be edge-machined in the same way as a conventional particle board and have the dame strength as that board, whilst the particle board can be made lighter.

The cross-sectional surface of the intermediate layer preferably has at least one part of lower density situated between at least two stranded parts of higher density.

The particle board can thereby be manufactured with a smaller quantity of particles and binder, which helps to reduce the manufacturing cost. The particle board can be manufactured with shorter pressing times due to the lower density of certain parts in the intermediate layer of particles. This results in increased manufacturing capacity. These areas of lower density are confined to areas of the particle board which are not used for fastening objects, joints etc. This results in lower transport costs for the transport of processed particle boards.

At least one stranded part formed from particles, having a higher density than other surrounding parts, is suitably situated at a distance from and between two edge parts of said intermediate layer.

The particle board can thereby be processed cost-effectively by sawing up the particle board at the stranded part, so that hinges, fittings etc. can be fastened to the edge area of the particle board in the same way and resulting in the same strength as for conventional particle boards. Likewise, further higher-density parts may be applied between outer stranded parts in order to increase the strength of the particle board and to ensure an even thickness of the particle board.

The object is also achieved by the method of manufacture of a particle board which has a lower and an upper surface layer having a finer fraction of particles, and between these surface layers an intermediate layer having a coarser fraction of particles, the method comprising the following steps:

- even distribution of the finer fraction of particles, forming a first particle mat for forming said lower surface layer;
- distribution of the coarser fraction of particles, forming a second particle mat, on top of the finer fraction of particles by means of a distribution arrangement in such a way that at least in one area the coarser fraction of particles is applied more thickly than in at least one surrounding part;
- even distribution of the finer fraction of particles, forming a third particle mat, on top of the coarser fraction of particles for forming said upper surface layer; and compressing of the first, second and third particle mats whilst the thickness of said intermediate layer remains essentially constant, so that said intermediate layer has a varying density.

A distribution of particles in the particle board has thereby been achieved, the particle distribution in a particle board according to the invention of the same thickness as a conventional particle board advantageously resulting in a reduced material consumption and a lighter final product.

Alternatively the method is characterized by partial dispensing of the coarser fraction of particles for distribution, prepressing of the coarser fraction partially dispensed and dispensing of the remaining quantity for forming the second particle mat.

This reduces the risk of particles from the thicker part subsiding, and the quantity of particles can therefore be concentrated in a more confined area, so that the remaining area of the intermediate layer can be produced cost-effectively with a smaller quantity of particles.

The method of distributing the coarser fraction of particles is preferably characterized by stranded spreading of core particles in strands of predetermined width through separate dispensers.

A distribution of particles can thereby be undertaken in a controlled manner and the thickness of the thinner part of particle mat of the intermediate layer, surrounding the thicker part can be adjusted. This also means that the quantity of particles in the intermediate layer can be determined very precisely.

The method of distributing the coarser fraction of particles is suitably characterized by direct dispensing of more particles to stranded parts by means of adjustable distribution members.

In this method the distribution of particles is achieved by means of adjustable distribution arrangements, which is cost-effective from the manufacturing standpoint. The distribution arrangement can be suitably controlled from a control room. The distribution arrangement is suitably designed so that it can be readily controlled from a control room in order to distribute particles evenly in the intermediate layer, producing an even density, should a customer require a conventional particle board.

Alternatively the method is characterized by a distribution of the coarser fraction of particles by means of exchangeable modular units of the distribution arrangement.

Particle boards from a modular system can thereby be adapted to the dimensions of a final product, such as the width of a cupboard door, for example, where hinges are fastened to one edge and a handle to the opposite edge.

DESCRIPTION OF THE DRAWINGS

The present invention will now be described in more detail with the aid of drawings attached, in which:

FIGS. 5*a* and 5*b* show a schematic representation of a modular system for distributing core particles;

FIG. 5*d* shows yet another embodiment in which the finished particle board is configured to have a higher density in areas intended for the fastening of objects;

DETAILED DESCRIPTION

The present invention will now be explained with reference to the drawings. For the sake of clarity, parts which are of no significance for the invention are omitted.

The term particle mat relates to the mass composed of adhesive-coated and distributed surface and core particles prior to hot-pressing. The term particle board relates either to a finish-pressed particle board delivered from a hot press on a production line, or a processed particle board which is sawn up with a length L and a width B to a customer's requirements.

Figure 1:
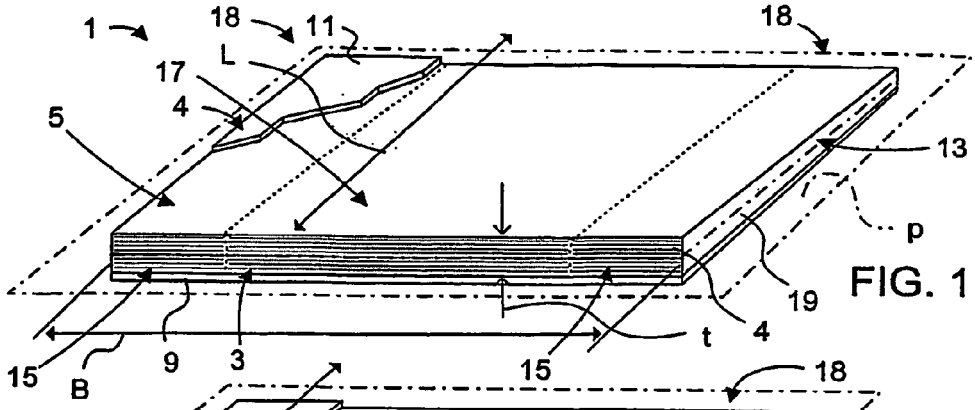
FIG. 1 shows a schematic representation of a particle board according to a first embodiment.

FIG. 1 shows a schematic perspective view of a particle board according to a first embodiment of the invention.

The particle board 1 is made from wood particles, also called chips 3, which are dried and screened into finer particles 4 and coarser particles 5. Each type of particle 4, 5 is then mixed with adhesive according to an adhesive coating method. The adhesive-coated particles 4, 5 are then spread out in layers forming a particle mat, which is then prepressed in a prepress and hot-pressed in a hot press 8 (see FIG. 8*a*) under pressure and heat, around 170-230° C., producing a finish-pressed particle board 1. The finish-pressed particle board 1 is cut and cooled before stacking. The surfaces can then be machined and the particle board 1 is cut to a width B and a length L according to customer requirements and the appearance of the final product.

The particle board 1 comprises a lower and an upper surface layer 9, 11 with the finer fraction of particles 4, the so-called surface particles, and an intermediate layer 13 of largely even thickness t between these surfaces layers 9, 11. The intermediate layer 13 comprises the coarser fraction of particles 5, the so-called core particles, the intermediate layer 13 being situated in a plane p and having a defined width B and a defined length L in a longitudinal direction.

Since the particle board 1 is made up of two outer stranded parts 15 composed of core particles and a part 17 of lower density situated between the stranded parts 15, the intermediate layer 13 has a varying density when viewed in a transverse direction to the longitudinal direction and along plane p. The core particles in the stranded parts 15 are tightly packed corresponding to the degree of packing in the intermediate layer of a conventional particle board, that is to say approximately 650-700 kg/m$^3$. The core particles in the part 17 between the stranded parts are less tightly packed than in the stranded parts 15 and have a density of 350-500 kg/m$^3$. The part 17 with core particles situated between the stranded parts 15 therefore has a lower weight and requires less material, such as particles and adhesive, whilst the thickness t (see also FIG. 9) is constant. The core particles in the part 17 situated between the stranded parts 15 are therefore compressed to a lesser degree than the core particles of the stranded parts 15, which gives a more porous intermediate layer 13 in the area between the stranded parts 15. The part 17 contains more and larger air pockets than the stranded parts 15. This more porous part builds up the thickness of the particle board. This saves material and the particle board 1 is advantageously more sound and heat-insulating than conventional particle boards.

Edge areas 18 of the particle board 1 coincide with areas of the higher-density intermediate layer, that is to say the stranded parts 15. This means that edge areas 18 of the particle board 1 can be used for fastening various types of objects, such as handles, hinges, locks etc., and can also be edge-machined in the say way as a conventional particle board. The particle board 1 is manufactured cost-effectively and the transport costs are reduced.

Figure 2:
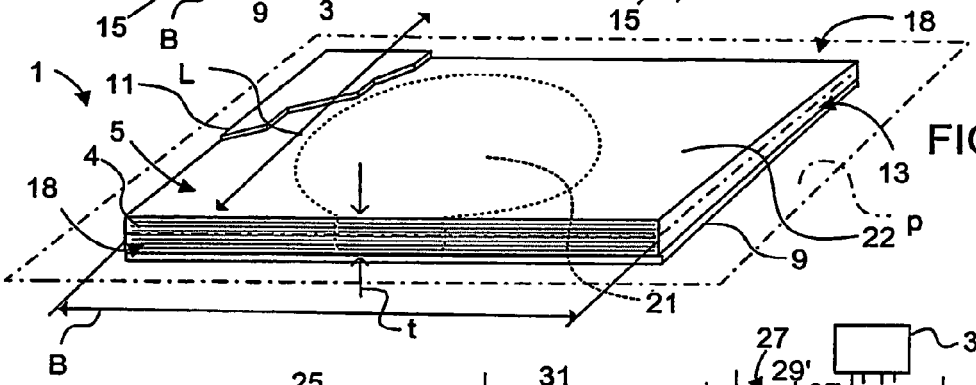
FIG. 2 shows a schematic representation of a particle board according to a second embodiment.

FIG. 2 shows a schematic perspective view of a particle board 1 according to a second embodiment. The intermediate layer 13 of the particle board 1 has a varying density viewed in a transverse direction to the longitudinal direction, such that the intermediate layer 13 has an extended part 21 formed from particles with a higher density than a surrounding part 22. The extended part 21 having a higher density than the surrounding part 22 is situated between two edge areas 18 of the intermediate layer 13. The particle board 1 can either be used for applications in which objects, such as handles etc. are fasted in the centre of the particle board 1. The particle board 1 in FIG. 2 can also be cut at the centre so that an end surface is formed that will permit conventional edge machining.

Figure 3:
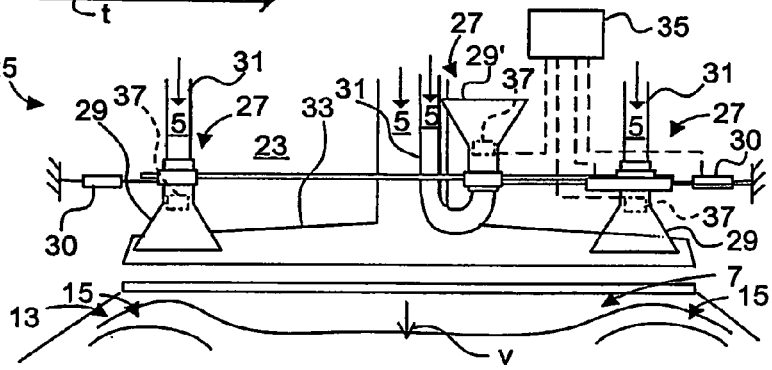
FIG. 3 shows a schematic representation of a first example of a spreading machine comprising a distribution arrangement.

FIG. 3 shows a schematic representation of a first example of a spreading machine 23 comprising a distribution arrangement 25. The distribution arrangement 25 is designed, by means of adjustable distribution members 27, to distribute the coarse fraction of particles 5 by directly spreading more particles 5 out where the stranded parts 15 are to be located. Each distribution member 27 for distributing particles 5 forming the stranded parts 15 comprises a nozzle 29, 29' coupled by way of a pipe 31 to a container (not shown) with adhesive-coated particles 5 of the coarser fraction.

Each nozzle 29, 29' is displaceable in a transverse direction to the longitudinal direction of the stranded parts 15. The centremost nozzle 29' is at present swung up and is not in use. A second nozzle 33 designed to cover the entire width of the particle mat 7 applies the remaining core particles 5. When a further stranded part 15 is placed in the intermediate layer 13 in order to modify the characteristics of the particle board according to customer requirements, an operator (not shown) in a control room 35 guides the centremost nozzle 29' into position for distributing core particles. The operator adjusts a throttle element 37 in order to distribute the quantity of particles 5 according to the conveying speed v of the particle mat 7 and the nozzle 29, 29' is moved by means of cylinders 30 or screws or the like. Strands of different widths can be produced by changing nozzles.

Figure 4A:
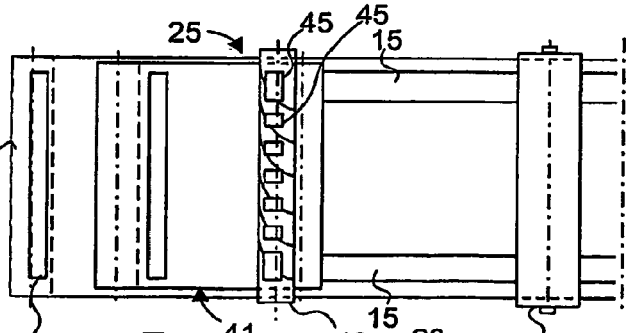
FIGS. 4*a* and 4*b* show a schematic representation of a second example of a spreading machine comprising a distribution arrangement.
Figure 4B:
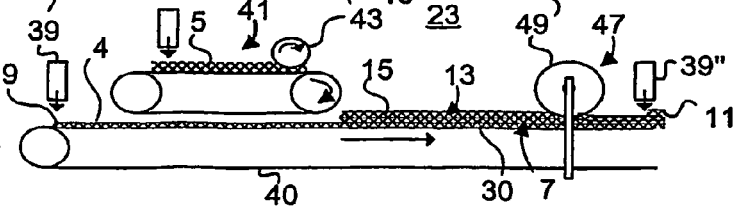

FIG. 4*a* shows a schematic top view and FIG. 4*b* a side view of a second example of a spreading machine 23 comprising a distribution arrangement 25. A first spreading nozzle 39' spreads the surface particles 4 of the finer fraction out evenly on a synthetic belt 40. The synthetic belt may also be sheet metal or wire. The coarser fraction of core particles 5 is spread out, either all distributed evenly or distributed evenly only in certain parts, on an upper conveyor 41 and is distributed by a rotating distribution roller 43 containing openings 45 for distributing the core particles 5 on top of the surface particles 4. The size of the openings 45 is adjustable and is controlled from a control room (not shown). By controlling the area of the openings 45 of the distribution roller 43, a larger quantity of particles 5 can be applied on the surface particles 4 in order to form the stranded parts 15. The core particles 5 can thereby be controlled so that they are spread in strands of equal or varying width with a predetermined distance between one another. A prepress 47 comprising a roller 49 that can be raised and lowered compresses the particle mat 7 before a second spreading nozzle 39" applies the upper surface layer 11 on top of the intermediate layer 13. The particle mat 13 is then conveyed to the hot press 8 (see FIGS. 8*a* and 8*b*).

FIGS. 5*a* and 5*b* show a schematic representation of an example of a modular system for distributing core particles. FIG. 5*a* shows the building-up of a particle mat 7, comprising five stranded parts 15 of an intermediate layer 13, by means of a first modular unit 51' comprising adjustable spreader elements 53. FIG. 5*b* shows a second modular unit 51" comprising spreader elements 53 for distributing core particles according to required widths of the processed particle boards 1, in which the position of edge areas of the processed particle board 1 for the fastening of objects 52 must coincide with the stranded parts 15. FIG. 5*b* illustrates how the particle board 1 is manufactured with four stranded parts 15, the two inner stranded parts being wider that the outer stranded parts 15. In width, three particle boards 1 can here be taken from the finish-pressed particle board 1. The synthetic belt 40 serves as base and coveys the particle mat in the direction v. The synthetic belt may also consist of sheet metal plates or wire. The particle board 1 can be adapted to customer requirements by changing modular units 51', 51" in accordance with the modular system. The spreader elements 53 are adjustable both vertically and laterally and are designed as plough elements.

Figure 5C:
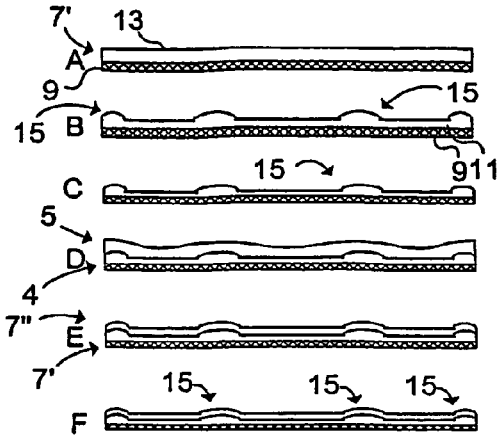
FIG. 5*c* shows a schematic cross-section of various parts of a particle mat having different quantities of particles in the intermediate layer.

FIG. 5*c* shows a schematic cross-section of various sections A-F of a particle mat 7 having different quantities of core particles in the intermediate layer 13, the sections A-F reoccurring in FIG. 5*b*.

FIG. 5*d* shows yet another embodiment of the invention in which adjustable spreader elements 153 are adjustable in the x- and z-direction for spreading the core particles both in a longitudinal direction and in lateral direction, with the result that the finished particle board 1 will have a higher density in areas where the particle board is intended for the fastening of objects 52 to all edges of the board. The figure shows a stationary plate which is covered with particles. If a moving conveyor belt is used, the spreader elements 153 can be designed to be moveable by moving the spreader elements 153 in a transverse direction (z-direction), in the conveying direction of the conveyor belt to such a degree that a transverse strand is obtained. Diagonal strands can be produced in the same way. A particle board 1, processed to form a cupboard side, for example, can thereby be manufactured in such a way that all edge areas of the cupboard side can have a higher density for fastening fittings, top and bottom, shelves, back piece etc. With a low density of 350 kg/m$^3$ in the middle layer between the stranded parts, edge parts across the stranding direction can also be designed with transverse strands 15, so that the edge surface can be puttied or painted for final treatment A first spreader member 55' first applies adhesive-coated surface particles 4 evenly on the synthetic belt 40 as a first particle mat 7'. An even distribution of the finer fraction of particles 4, forming the first particle mat 7', constitutes the lower surface layer 9 in the finished particle board 1. The core particles are then spread, as a partial dispensation, on top of the surface particles, evenly distributed by means of a second spreader member 55". The cross-section in section A shows this schematically in FIG. 5*c*. FIG. 5*b* shows how the second modular unit 51" is inserted in the distribution arrangement 25 for distributing the core particles. The cross-section in B shows a schematic representation of the built-up stranded parts 15. The distribution is achieved by spreading out core particles in strands by means of jointly or individually controlled spreader elements 53 for building up the stranded parts 15 and surrounding part 22 to form a second particle mat 7". In a first step a prepress 47' presses this second particle mat 7" so that the risk of subsidence in the stranded parts 15 is reduced. See section C.

A third spreader member 55" spreads out the remaining quantity of core particles 5 to complete the second particle mat 7" (see section D). This quantity of core particles 5 is further distributed by means of a second set of spreader elements, so that after hot pressing the intermediate layer 13 of the particle board 1 acquires a largely even thickness t. The further built-up of stranded parts 15 are illustrated schematically in section E.

The second particle mat 7" has therefore been built up in such a way that one area with the coarser fraction of particles 5, that is to say the stranded parts 15, is applied more thickly than the surrounding parts 22 with the coarser fraction.

The cross-section of the particle mat 7 is illustrated schematically in F. Finally, by means of a fourth spreader element 55"", the finer fraction of particles 4 is applied evenly on the second particle mat 7", forming a third particle mat 7'", which constitutes the upper surface layer 11 of the finish-pressed particle board 1, following which the particle mat 7 is prepressed once again by means of a second prepress 47".

The particle mat 7 is then conveyed to the hot press 8 (see FIG. 8*a*), which under pressure and heat of approximately 160-230° C. by virtue of the setting characteristics of the adhesive produces the solid (hard) structure of the particle board 1 and makes the thickness of the finished particle board 1 largely constant. The finished particle board 1 is cooled and sawn into suitable lengths. The width B", B'" is sawn at a later stage in conjunction with the sawing of finished sizes, which will be explained in more detail below in connection with FIGS. 6 and 7.

Figure 6:
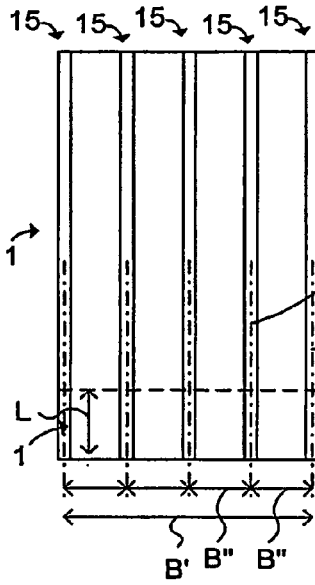
FIGS. 6 and 7 show a schematic representation of a particle board pressed ready further processing.

FIG. 6 shows a schematic representation of a finish-pressed particle board 1 comprising five stranded parts 15, which are produced by means of the distribution arrangement in FIG. 5*a* and the modular unit inserted therein, comprising a spreader element 51' or the so-called spreading unit. The stranded parts 15 extend essentially in the longitudinal direction of the particle board 1. The finish-pressed particle board 1 has an overall width B' of 2400 mm, for example, which may vary depending on the desired size format or press width and is sawn along the dot-and-dash lines corresponding to the centre lines CL of each stranded part 15. The distance between these centre lines will correspond approximately to the widths B" of the processed particle boards. The outer saw cuts 48 are made for trimming irregularities from the edges 19 of the particle board 1. The surplus material is returned for the production of new particle boards 1. The particle boards 1 for processing acquire a width B" and are cut to a suitable length L. Each particle board 1 now acquires a machinable edge 19 and has a solid area for fastening objects 52, such as hinges, locks etc. The particle board 1 can thereby be used in the furniture industry, for example, in the same way as particle boards 1 manufactured by conventional methods. The major difference is that the particle board 1 is 30% lighter than a conventional particle board and that 25% less material may be used than in the manufacture of a conventional particle board. The particle board 1 is manufactured with a smaller quantity of particles and binder, which helps to reduce the cost of manufacture. The particle board 1 is manufactured with shorter press times owing to lower overall density of the intermediate layer 13 of particles 5. This results in increased manufacturing capacity.

Figure 7:
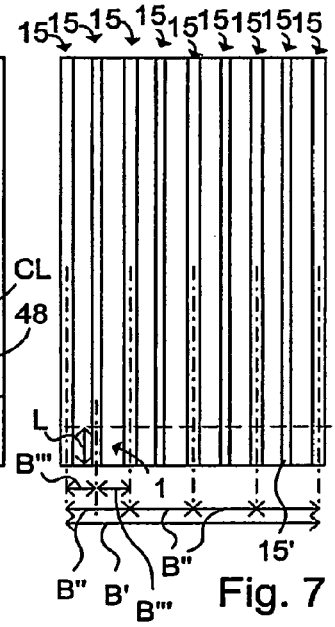

FIG. 7 shows a finish-pressed particle board 1 comprising nine narrower and wider stranded parts 15. That is to say further saw cuts can be made in the narrower stranded parts 15 if a particle board 1 of a width B'" of 300 mm is required. A particle board 1 600 mm wide can also be supplemented by a stranded part 15' between the outer stranded parts 15, in order to ensure an even thickness of the particle board 1 and in order to increase the strength of the particle board 1. By means of the spreading machine 23 shown in FIG. 4*a* an operator can control the distribution and the build-up of core particles according to how the finish-pressed particle board 1 is to be divided up into multiple particle boards for separate use within the furniture industry, for example. The intermediate layer 13 has a higher density in areas, that is to say in the areas for saw cuts and the stranded parts 15, where the particle board 1 is intended for fastening to another object 52.

Figure 8A:
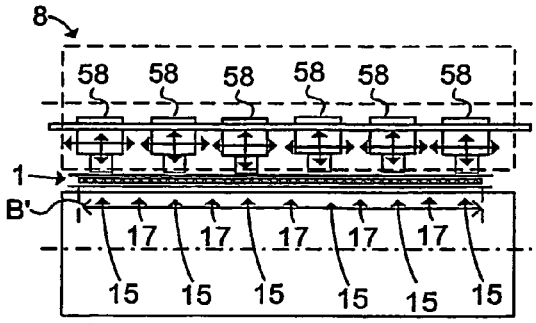
FIGS. 8*a* and 8*b* show schematic representations of a hot press designed for compressing of the particle mat.
Figure 8B:
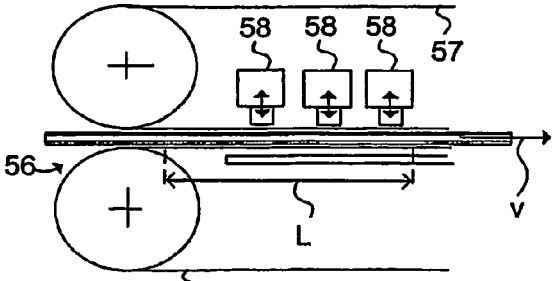

FIG. 8*a* shows a schematic front view of an adjustable hot press 8, that is to say in the conveying direction v. FIG. 8*b* shows a side view of the hot press. The particle mats 7', 7", 7'" previously compressed in the prepress 47 are fed into the continuous hot press 8 by means of endless drive belts 57 at a first end 56 and are delivered at a second end (not shown). The temperature and the pressure are adjusted according to the structure and composition of the particle mat 7, the distribution of core particles etc. By means of a number of pressure cylinders 58 which are arranged side by side and in series along the drive belts 57 and which can be controlled from the control room (not shown), different parts of varying density can be exposed to different pressures. For example, the pressure can be set very high in the areas of stranded parts 15 having a greater density than parts 17 of lower density. This makes it possible to optimize the structure of the particle board. If, in the spreading machine 23, stranded parts 15 intended for edge parts 18 have been built up higher with a larger quantity of particles in order to produce a higher density in these parts, a greater pressure can be applied to these parts, so that a higher density of the particle board 1 is obtained in the edge parts 18. The pressure cylinders 58 are adjusted so that the particle board 1 is manufactured with a largely constant thickness over the entire width B and the length L.

Figure 9:
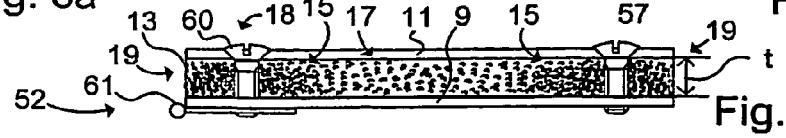
FIG. 9 shows a schematic representation of the particle board in FIG. 1 with objects attached.

FIG. 9 shows a schematic representation of the particle board 1 in FIG. 1 with an object 52 in the form of a hinge 61 attached by means of rivets 60. The particle board 1 is shown in schematic form in order to reveal variations in the density of the intermediate layer 13 of core particles. In the furniture industry it is common practice to assemble particle boards together and fit fittings such as hinges, handles etc. to edge areas of the particle boards. By adjusting the distance between the stranded parts 15 according to the width of the processed particle board, and by customizing the finish-pressed particle board, so that in sawing up (the saw cuts are made in the stranded parts) this is divided into widths corresponding to the specified measurements of the furniture manufacturer and according to the required strength of the particle board for fastening objects, the furniture manufacturer can substantially reduce his transport ands production costs.

The present invention is not limited to the exemplary embodiments described above, combinations of the exemplary embodiments described and similar solutions being possible without departing from the scope of the invention. Particles other than wood particles may obviously be used. Core particles that are applied between the stranded parts may be adhesive-coated more heavily than core particles which are applied in the stranded parts and can be guided separately to a nozzle for application. The thickness of the particle board may likewise be varied according to requirements. Alternatively the finer fraction of particles may be used in the stranded parts also in the middle layer. The finer fraction can similarly also be used for the entire middle layer.

Types of production line other than those described above may be used. Besides a continuous press, a so-called intermittent load press may be used. All parameters for the manufacture of a particle board according to the present invention may be controlled and monitored from a control room.

That which is claimed:

1. A method for the manufacture of a multi-layer particle board, said method comprising the steps of:

evenly distributing a plurality of a finer fraction of particles so as to form a first particle mat, the first particle mat forming a lower surface layer of the particle board;

distributing, via a distribution arrangement, a plurality of a coarser fraction of particles so as to form a second particle mat on top of the lower surface layer, the second particle mat forming an intermediate surface layer of the particle board, the intermediate surface layer having one or more first regions of relatively more thickly applied particles and one or more second regions of relatively more thinly applied particles;

evenly distributing a plurality of the finer fraction of particles so as to form a third particle mat on top of the intermediate surface layer, the third particle mat forming an upper surface layer of the particle board; and compressing the first, second, and third particle mats until the intermediate surface layer acquires an essentially constant thickness and a varying density, wherein the one or more first regions have a relatively higher density than the one or more second regions.

2. The method of claim 1, wherein the step of distributing the plurality of the coarser fraction of particles comprises the sub-steps of:

dispensing, via said distribution arrangement, a first partial portion of the coarser fraction of particles on top of the lower surface layer;

prepressing the first partial portion of the coarser fraction of particles; and dispensing, via said distribution arrangement, a second partial portion of the coarser fraction of particles on top of the prepressed first partial portion, the first and the second partial portions forming the intermediate surface layer of the particle board.

3. The method of claim 1, wherein the distribution arrangement comprises at least one adjustable spreader element configured to dispense the coarser fraction of particles more thinly across a desired distance between two successively positioned first regions of the one or more first regions of the intermediate surface layer.

4. The method of claim 1, wherein the distribution arrangement comprises one or more adjustable spreader elements configured to directly dispense the coarser fraction of particles more thickly in the one or more first regions than in the one or more second regions of the intermediate surface layer.

5. The method of claim 1, wherein the distribution arrangement comprises one or more exchangeable modular units configured to perform the step of distributing the plurality of the coarser fraction of particles.

6. The method of claim 1, wherein the distribution arrangement comprises one or more adjustable spreader elements configured to be selectively movable so as to spread the coarser fraction of particles in at least one of a longitudinal direction and in a lateral direction.

7. The method of claim 6, wherein movement of the one or more adjustable spreader elements in solely the lateral direction forms at least one transverse strand.

8. The method of claim 6, wherein movement of the one or more adjustable spreader elements in at least some degree of the longitudinal direction and the lateral direction forms at least one diagonal strand.

* * * * *